US009994428B2

(12) United States Patent
Dai et al.

(10) Patent No.: US 9,994,428 B2
(45) Date of Patent: Jun. 12, 2018

(54) BRAKE FOR USE IN PASSENGER CONVEYOR SYSTEM

(71) Applicant: Otis Elevator Company, Farmington, CT (US)

(72) Inventors: Du Dai, Shanghai (CN); Alois Senger, Gresten (AT); Jian Cheng, Shanghai (CN)

(73) Assignee: Otis Elevator Company, Farmington, CT (US)

( * ) Notice: Subject to any disclaimer, the term of this patent is extended or adjusted under 35 U.S.C. 154(b) by 0 days. days.

(21) Appl. No.: 15/033,843

(22) PCT Filed: Nov. 18, 2013

(86) PCT No.: PCT/CN2013/087356
§ 371 (c)(1),
(2) Date: May 2, 2016

(87) PCT Pub. No.: WO2015/070462
PCT Pub. Date: May 21, 2015

(65) Prior Publication Data
US 2016/0251204 A1 Sep. 1, 2016

(51) Int. Cl.
*B66B 29/00* (2006.01)
*B66B 5/02* (2006.01)
*B66B 23/02* (2006.01)

(52) U.S. Cl.
CPC ..... *B66B 29/00* (2013.01); *B66B 5/02* (2013.01); *B66B 23/026* (2013.01)

(58) Field of Classification Search
CPC ..... B66B 29/00; B66B 5/02; B66B 23/026
USPC ..... 198/322, 323, 330, 334
See application file for complete search history.

(56) References Cited

U.S. PATENT DOCUMENTS

| | | | | |
|---|---|---|---|---|
| 2,408,203 A | | 9/1946 | Eames et al. | |
| 2,460,017 A | | 1/1949 | Lautrup | |
| 3,830,344 A | | 8/1974 | Cervenec et al. | |
| 4,231,452 A | | 11/1980 | Kraft | |
| 4,600,865 A | | 7/1986 | Caputo | |
| 4,664,247 A | * | 5/1987 | Wolf | B66B 25/00 192/226 |
| 5,295,568 A | * | 3/1994 | Saito | B66B 29/02 198/330 |
| 5,337,878 A | * | 8/1994 | Mehlert | B66D 5/08 188/171 |
| 6,155,401 A | * | 12/2000 | Lunardi | B66B 23/026 198/322 |

(Continued)

FOREIGN PATENT DOCUMENTS

| | | |
|---|---|---|
| CN | 102398845 A | 4/2012 |
| CN | 102849597 A | 1/2013 |

(Continued)

OTHER PUBLICATIONS

Office Action for CN201380081016.3 dated Apr. 5, 2017.
EP search report for EP13897548.7 dated Jun. 27, 2017.

*Primary Examiner* — Douglas A Hess
(74) *Attorney, Agent, or Firm* — O'Shea Getz P.C.

(57) ABSTRACT

A brake for use in a passenger conveyor system is provided. The passenger conveyor system includes a drive system operable to drive a drive component in a desired direction. The brake is actuated by a reversal in direction of movement of the drive component.

30 Claims, 7 Drawing Sheets

(56) References Cited

U.S. PATENT DOCUMENTS

| | | | | |
|---|---|---|---|---|
| 6,247,575 | B1 | 6/2001 | Thiel | |
| 6,273,234 | B1 | 8/2001 | Balzer-Apke et al. | |
| 6,520,300 | B2 | 2/2003 | Balzer-Apke et al. | |
| 6,666,319 | B2 | 12/2003 | Balzer-Apke et al. | |
| 6,827,196 | B2 * | 12/2004 | Wiesinger | B66B 29/005 198/322 |
| 6,896,119 | B2 | 5/2005 | Wiesinger et al. | |
| 6,966,420 | B2 * | 11/2005 | Ackmann | B66B 23/02 198/330 |
| 6,971,496 | B1 | 12/2005 | Nurnberg et al. | |
| 7,168,547 | B2 * | 1/2007 | Thaler | B66B 23/028 198/322 |
| 7,308,978 | B2 | 12/2007 | Matheisl | |
| 7,950,514 | B1 | 5/2011 | Nurnberg et al. | |
| 8,534,444 | B2 * | 9/2013 | Senger | B66B 29/00 198/323 |
| 8,839,942 | B2 * | 9/2014 | Tautz | B66B 29/005 198/323 |
| 2003/0000798 | A1 | 1/2003 | Williams et al. | |
| 2009/0173586 | A1 | 7/2009 | Seeger et al. | |
| 2012/0055740 | A1 | 3/2012 | Allington et al. | |
| 2012/0073933 | A1 | 3/2012 | Senger | |
| 2013/0153362 | A1 | 6/2013 | Gonzalez Alemany et al. | |

FOREIGN PATENT DOCUMENTS

| | | | |
|---|---|---|---|
| CN | 202848837 | U | 4/2013 |
| FR | 2885895 | A3 | 11/2006 |
| GB | 2410484 | A | 8/2005 |
| JP | 1095586 | | 4/1998 |
| JP | 2006143424 | A | 6/2006 |
| JP | 2011046483 | A | 3/2011 |
| KR | 100388156 | B1 | 6/2003 |
| RU | 2044683 | C1 | 9/1995 |

* cited by examiner

BRAKE FOR USE IN PASSENGER CONVEYOR SYSTEM

This application claims priority to PCT Patent Application No. PCT/CN2013/087356 filed Nov. 18, 2013, which is hereby incorporated herein by reference in its entirety.

BACKGROUND

1. Technical Field

Aspects of the present invention relate to a brake, and more particularly relate to a brake for use in a passenger conveyor system.

2. Background Information

It is known to provide a passenger conveyor system (e.g., a moving sidewalk system, an elevator system, an escalator system) that includes a drive system that is operable to drive one or more drive components (e.g., a moving sidewalk sprocket and pallet band, an elevator sheave and rope, an escalator sprocket and step band) in a desired direction. The passenger conveyor system conventionally includes a progressive brake that aids in slowing and/or stopping reverse movement of the drive components, but only after a relatively long time period has elapsed. In some instances, this can be problematic, because it can create an unsafe situation in which passengers are at a risk. The use of a non-progressive, or instantaneous, brake is discouraged in passenger conveyor systems due to the risks associated with exposing passengers to high deceleration rates. Aspects of the present invention are directed to these and other problems.

SUMMARY OF ASPECTS OF THE INVENTION

According to an aspect of the present invention, a brake for use in a passenger conveyor system is provided. The passenger conveyor system includes a drive system operable to drive a drive component in a desired direction. The brake is actuated by a reversal in direction of movement of the drive component.

According to another aspect of the present invention, a passenger conveyor system is provided that includes a drive system and a brake. The drive system is operable to drive a drive component in a first direction. The brake is operable to brake the drive component to prevent an overspeed condition in which the drive component moves in the first direction at a speed greater than a predetermined threshold speed, and is operable to brake the drive component to prevent movement of the drive component in a second direction that is a reverse of the first direction. The non-reversal function of the brake is actuated by a change in direction of movement of the drive component from the first direction to the second direction.

According to another aspect of the present invention, a method for operating a passenger conveyor system is provided, including the steps of: (1) operating a drive system of the passenger conveyor such that a drive component of the drive system is driven in a desired direction; and (2) actuating a brake, wherein the brake is actuated by a change in direction of movement of the drive component from the desired direction to a reverse direction.

Additionally or alternatively, the present invention may include one or more of the following features or steps individually or in combination:

the passenger conveyor system is an elevator system;

the passenger conveyor system is an escalator system;

the brake instantaneously brakes the drive component when actuated by the reversal in direction of movement of the drive component;

the brake slows movement of the drive component at a deceleration rate greater than 1 meter/second$^2$;

the brake progressively brakes the drive component when actuated by the reversal in direction of movement of the drive component;

the brake is operable to brake the drive component to prevent an overspeed condition in which the drive component moves in the desired direction at a speed greater than a predetermined threshold speed;

the drive system is operable to rotationally drive the drive component in the desired direction, and the brake further includes:

an outer ring connected to the drive component such that the outer ring and the drive component are concentrically aligned about a rotation axis; and an inner block disposed within a cavity defined by the outer ring such that the inner block and the outer ring are axially and concentrically aligned, the inner block being configured such that a first channel is formed between the inner block and the outer ring.

a first roller positioned within the first channel, the first roller being moveable within the first channel between an active position and an inactive position;

when the first roller is in the active position, the first roller is operable to interact with the inner block and the outer ring to instantaneously brake the outer ring, which in turn instantaneously brakes the drive component of the drive system, and when the first roller is in the inactive position, the first roller is not operable to interact with the inner block and the outer ring to instantaneously brake the outer ring;

an actuator operable to move the first roller between the active position and the inactive position;

a first wedge positioned within the first channel, the first wedge being moveable within the first channel between an active position and an inactive position;

when the first wedge is in the active position, the first wedge is operable to interact with the inner block and the outer ring to brake the outer ring, which in turn brakes the drive component of the drive system, and when the first wedge is in the inactive position, the first wedge is not operable to interact with the inner block and the outer ring to brake the outer ring;

interaction between the first wedge, the inner block, and the outer ring is operable, by itself, to move the first wedge within the first channel, until the first wedge, the inner block, and the outer ring interact to hold the outer ring;

an actuator operable to move the first wedge between the active position and the inactive position;

the brake is self-actuated by the reversal in direction of movement of the drive component; and the brake is provided as a single unit.

These and other aspects of the present invention will become apparent in light of the drawings and detailed description provided below.

DETAILED DESCRIPTION OF ASPECTS OF THE INVENTION

Figure 1:
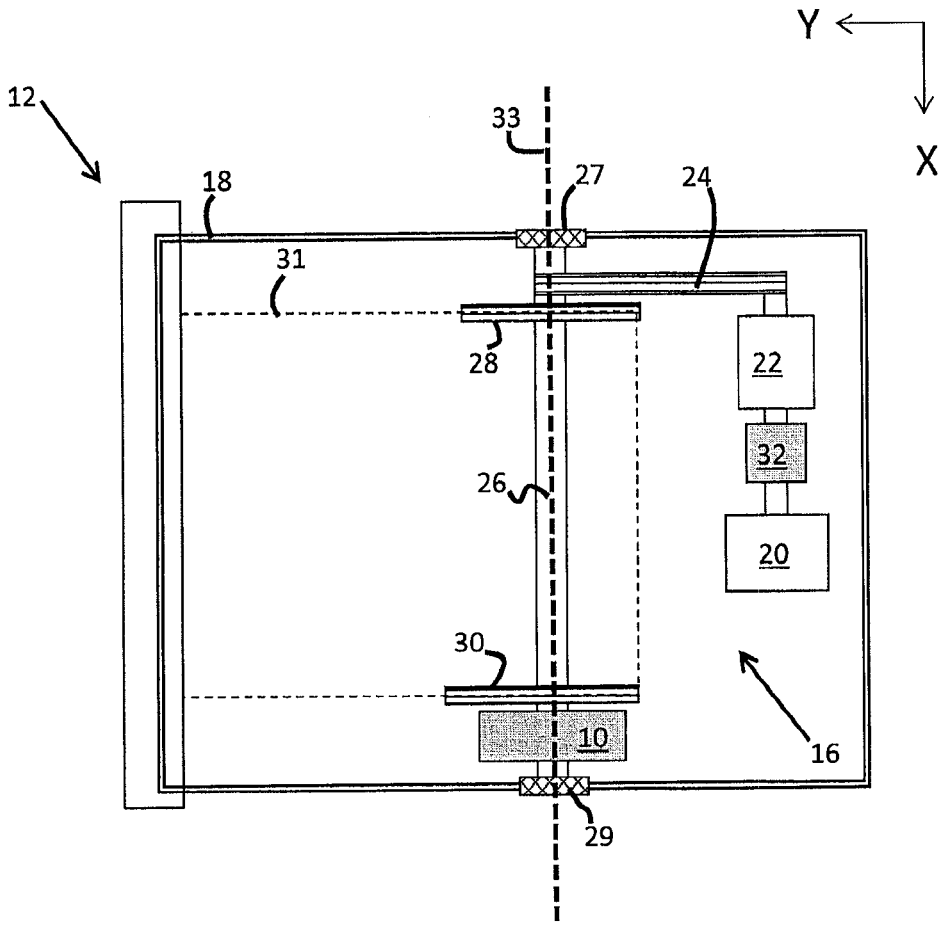
FIG. 1 illustrates a schematic top plan view of a passenger conveyor system that includes a brake.

Referring to FIG. 1, the present disclosure describes embodiments of a brake 10 for use in a passenger conveyor system 12, and describes methods for operating the passenger conveyor system 12. The passenger conveyor system 12 includes a drive system 16 that is operable to drive one or more drive components of the drive system 16 in a desired direction (e.g., a forward direction, an upward direction, a downward direction). The brake 10 is actuated by a reversal in direction of movement of the drive components. The present disclosure describes aspects of the present invention with reference to the exemplary embodiment illustrated in the drawings; however, aspects of the present invention are not limited to the exemplary embodiment illustrated in the drawings. The present disclosure may describe a feature as having a length extending relative to an x-axis, a width extending relative to a y-axis, and/or a height extending relative to a z-axis. The drawings illustrate the respective axes.

The brake 10 is operable for use in various types of passenger conveyor systems 12. In the illustrated embodiment, the passenger conveyor system 12 is an escalator system. In other embodiments, the passenger conveyor system 12 can be a moving sidewalk system (e.g., a moving sidewalk system that moves passengers through an incline). In other embodiments, the passenger conveyor system 12 can be an elevator system (e.g., an elevator system in which an elevator car travels in a single direction, such as upward, in one hoistway and the opposite direction, such as downward, in an adjacent hoistway). For ease of description, the passenger conveyor system 12 will hereinafter be referred to as the "escalator system 12".

The escalator system 12, and components thereof, can be configured in various different ways. Referring to FIG. 1, in the illustrated embodiment, the escalator system 12 includes an escalator housing 18, and the drive system 16 is partially disposed within the escalator housing 18. The drive system 16 includes a plurality of drive components, including a drive motor 20, a gearbox 22, a transmission device 24 (e.g., a chain), a drive shaft 26, one or more band engagement members 28, 30 (e.g., sprockets), and an escalator step band 31. The escalator step band 31 includes structure (not shown) that enables a plurality of escalator steps (not shown) to be attached thereto. The gearbox 22 includes an input portion and an output portion. The input and output portions of the gearbox 22 are in geared connection with one another. The drive shaft 26 extends along an axial centerline 33, between a first end portion and an opposing second end portion. The first and second end portions of the drive shaft 26 rotate within first and second bearings (not shown), respectively. The first and second bearings are connected to opposing walls of the escalator housing 18 using respective first and second truss members 27, 29. The transmission device 24 is a chain. The drive motor 20 is connected to the input portion of the gearbox 22. The output portion of the gearbox 22 engages the transmission device 24. The transmission device 24 engages the first end portion of the drive shaft 26. A first band engagement member 28 (hereinafter the "first sprocket 28") is connected to the first end portion of the drive shaft 26. A second band engagement member 30 (hereinafter the "second sprocket 30") is connected to the second end portion of the drive shaft 26. The first and second sprockets 28, 30 each include an annular base portion connected to the outer surface of the drive shaft 26, an annular web portion that extends radially outward from the base portion, and a plurality of teeth that extend radially outward from the web portion. The teeth of the first and second sprockets 28, 30 are operable to engage the escalator step band 31 to transfer rotational energy from the drive shaft 26 to the escalator step band 31.

The brake 10 can be configured within the escalator system 12 in various different ways. In the illustrated embodiment, the brake 10 is an auxiliary brake that is disposed relative to the drive shaft 26 and the second sprocket 30. The escalator system 12 additionally includes an operational brake 32 disposed relative to the drive motor 20 and the gearbox 22.

As described above, the brake 10 is actuated by a reversal in direction of movement of the drive components. The term "actuated", and variations thereof, are not used herein to imply that a separate actuator is (or is not) provided. In the illustrated embodiment, a separate actuator is not provided; the brake 10 is self-actuated by a reversal in direction of movement of the drive components, as will be described below. In other embodiments not illustrated in the drawings, a separate actuator is provided.

In some embodiments, when the brake 10 is actuated by a reversal in direction of movement of the drive components the brake 10, as described above, instantaneously brakes (e.g., slows and/or stops movement of) one or more drive components of the drive system 16. A person having ordinary skill in the art will understand that the term "instantaneous", and variations thereof, are used herein to describe that the braking action of the brake 10 is almost immediate; the term "instantaneous", and variations thereof, are not used herein to describe that the braking action of the brake 10 occurs within an infinitely short time period. A person having ordinary skill in the art will also understand that the brake 10 can be contrasted with a progressive brake, which is operable to brake drive components only after a substantially longer time period. Some safety codes for passenger conveyor systems, such as EN115, dictate a 1 meter/second$^2$ maximum stopping deceleration for brakes, which requires a progressive brake. In some embodiments, the brake 10 can instantaneously brake one or more drive components of the drive system 16 at a deceleration rate that is significantly higher than a deceleration rate of a comparable progressive brake or the safety code dictated rate. In some embodiments, for example, the brake 10 can instantaneously brake one or more drive components at a deceleration rate (e.g., 2 m/s$^2$, 3 m/s$^2$, 4 m/s$^2$, 5 m/s$^2$) that is significantly higher than 1 m/s$^2$.

In some embodiments, the brake 10 is additionally operable to hold a position of one or more drive components of the drive system 16 (e.g., the escalator step band 31) after movement of the drive components has stopped. In other embodiments not shown in the drawings, the brake 10 can be used, for example, to hold a position of an elevator car at a landing.

In some embodiments, including the illustrated embodiment, the brake 10 is operable to brake one or more drive components of the drive system 16 when the drive components are moved in a desired direction (e.g., a forward direction, an upward direction, a downward direction), and the brake 10 is independently operable to brake (e.g., slow and/or stop movement of) the drive components when there is a reversal in direction of movement of the drive components.

Figure 2:
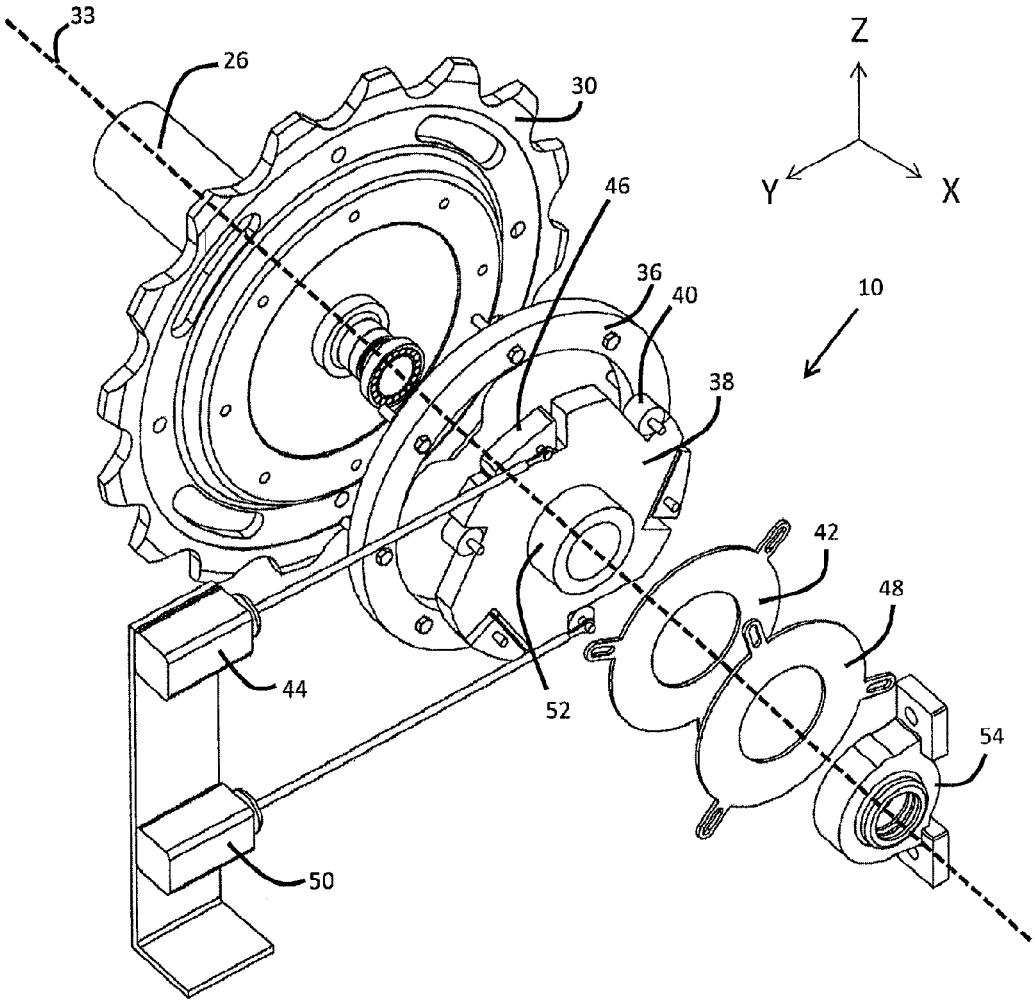
FIG. 2 illustrates an exploded perspective view of components of the passenger conveyor system of FIG. 1, including components of the brake.
Figure 3:
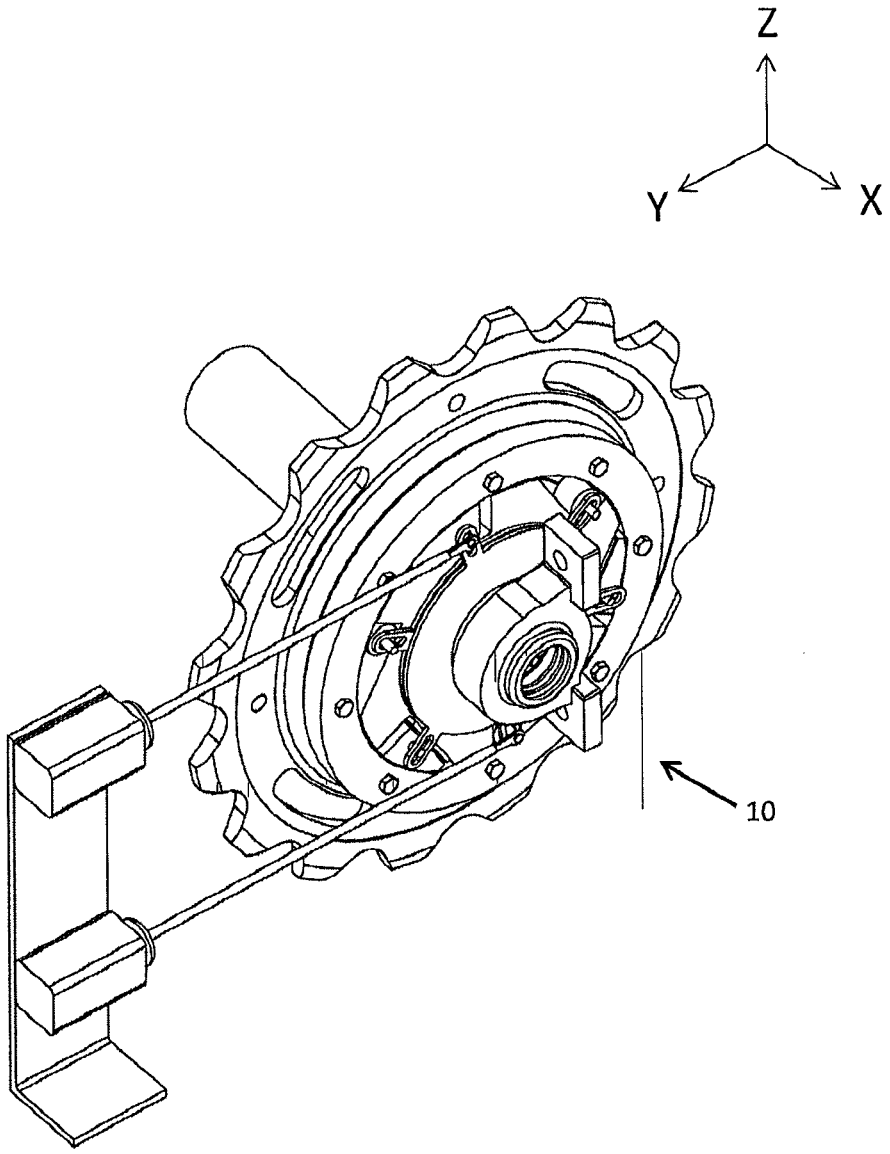
FIG. 3 illustrates a perspective view of components of the passenger conveyor system of FIG. 1, including components of the brake.
Figure 4:
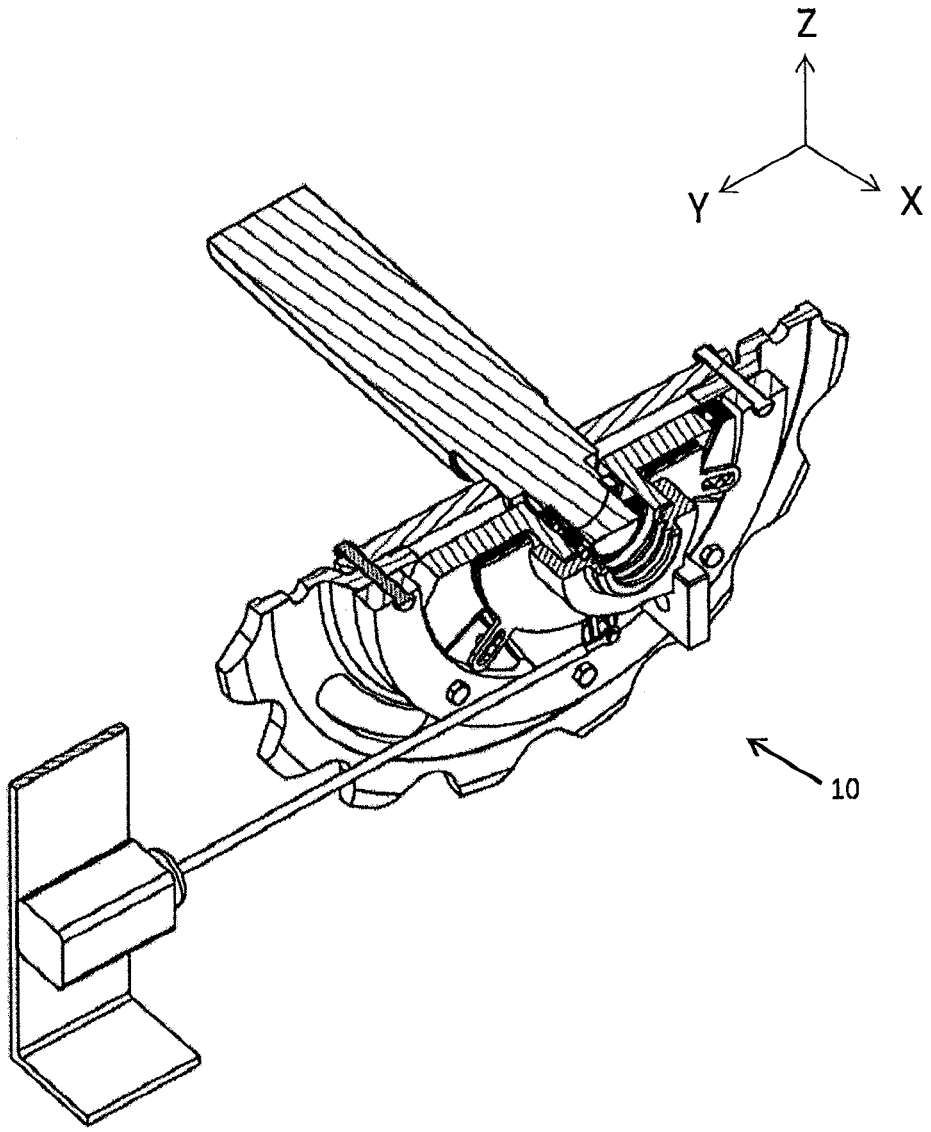
FIG. 4 illustrates a sectional perspective view of components of the passenger conveyor system of FIG. 1, including components of the brake.

The brake 10 can be implemented in various different ways. Referring to FIG. 2, in the illustrated embodiment, the brake 10 includes an outer ring 36, an inner block 38, one or more rollers 40, a roller dial plate 42, a first actuator 44, one or more wedges 46, a wedge dial plate 48, and a second actuator 50.

In the illustrated embodiment, the outer ring 36 includes a radially inner surface, a radially outer surface, and first and second face surfaces that extend radially between the inner and outer surfaces. The first face surface of the outer ring 36 is connected to a face surface of the second sprocket 30 such that the outer ring 36 and the second sprocket 30 each are concentrically aligned about the centerline 33.

Figure 5:
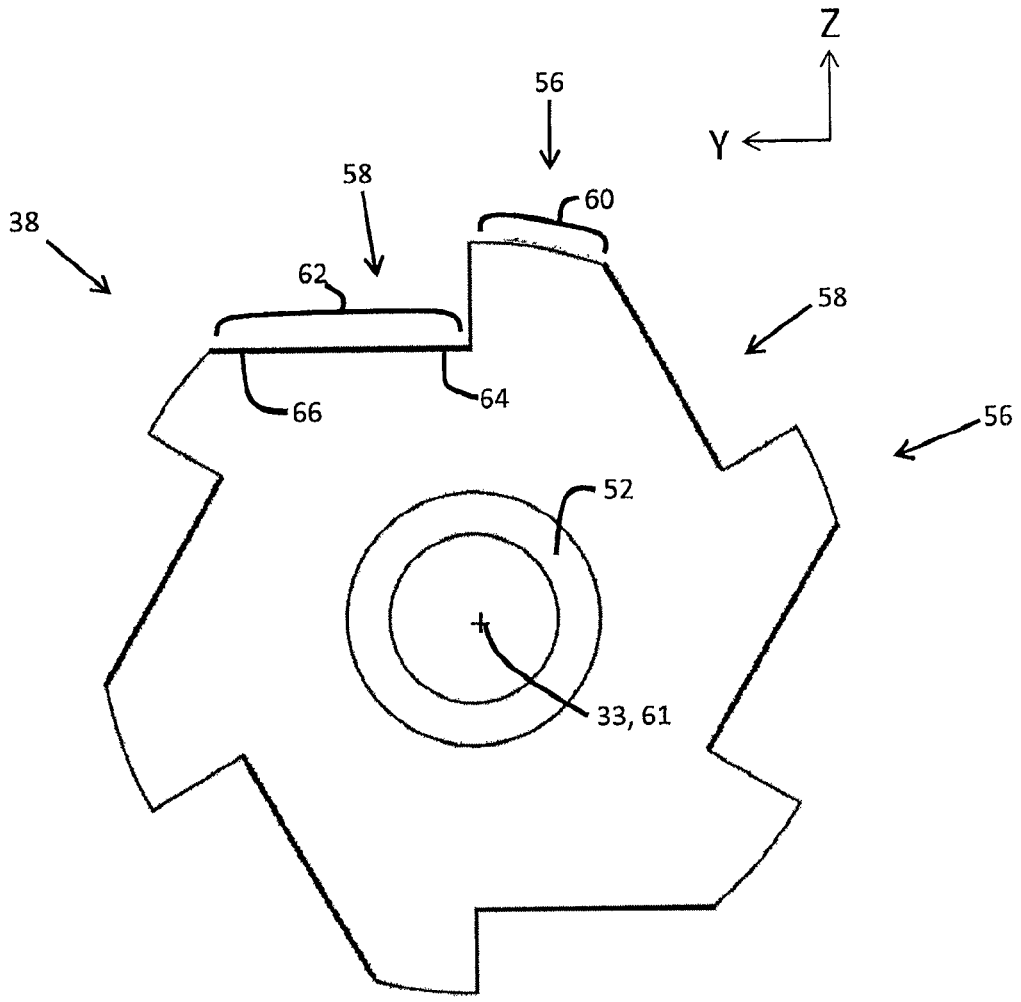
FIG. 5 illustrates a front elevation view of a component of the brake of FIG. 1.

Referring to FIG. 5, in the illustrated embodiment, the inner block 38 includes an annular base portion and an annular web portion that extends radially outward from the base portion. The base portion of the inner block 38 includes an aperture through which the drive shaft 26 (see FIGS. 1 and 2) is operable to freely rotate. The inner block 38 includes an annular flange 52 (see also FIG. 2) that extends axially from the base portion of the inner block 38. The annular flange 52 is positionally-fixed relative to a pedestal 54 (see FIG. 2). The pedestal 54 is positionally-fixed relative to the second truss member 29 (see FIG. 1). The inner block 38 is shaped such that it includes a plurality of peaks 56 and a plurality of recesses 58. Each of the recesses 58 is disposed circumferentially between two of the peaks 56. Each of the peaks 56 forms a portion of the radially outer surface of the inner block 38 (hereinafter a "peak portion 60 of the outer surface"). Each of the recesses 58 form a portion of the radially outer surface of the inner block 38 (hereinafter a "recess portion 62 of the outer surface"). Each of the peak portions 60 of the outer surface extend circumferentially about the axial centerline 61 of the inner block 38 such that the radially-extending distances between the axial centerline 61 and the peak portions 60 (hereinafter the "peak radii") are at least substantially equal across the entirety of each peak portion 60, and are at least substantially equal from one peak portion 60 to the next. Each of the recesses 58 extend radially into the web portion of the inner block 38 such that the radially-extending distances between the axial centerline 61 and the recess portions 62 (hereinafter the "recess radii") are less than the peak radii. The recesses 58 of the inner block 38 are shaped such that each of the recess portions 62 of the outer surface of the inner block 38 are defined by a plurality of recess radii. The recesses 58 are shaped such that each of the recess portions 62 of the outer surface extend circumferentially from a first end 64 of the recess portion 62 having a first recess radius to a second end 66 of the recess portion 62 having a second recess radius that is greater than the first recess radius. In the illustrated embodiment, the inner block 38 is configured such that, when the inner block 38 and the outer ring 36 are axially and concentrically aligned, the inner block 38 is disposed within the cavity defined by the inner surface of the outer ring 36, and such that the peak portions 60 of the outer surface slidably engage the inner surface of the outer ring 36, and such that a radially- and circumferentially-extending channel is formed between each recess portion 62 of the outer surface of the inner block 38 and the inner surface of the outer ring 36.

Referring to FIG. 2, in the illustrated embodiment, a plurality of rollers 40 and a plurality of wedges 46 are positioned within the channels in an alternating manner as shown in the drawings.

In the illustrated embodiment, each roller 40 includes a cylindrical roller body that extends along an axial centerline, and a cylindrical roller flange that extends from the roller body along a lengthwise-extending axis that is co-axial with the axial centerline of the roller body. Each roller 40 is positioned within one of the above-described channels such that the roller body contacts a recess portion 62 of the outer surface of the inner block 38.

In the illustrated embodiment, each roller 40 is operable to be moved between an inactive position and an active position. In the illustrated embodiment, when a roller 40 is in the inactive position, the roller 40 is disposed proximate the first end 64 of the recess portion 62 of the outer surface of the inner block 38 (see FIG. 5). When a roller 40 is in the active position, the roller 40 is disposed proximate the second end 66 of the recess portion 62 of the outer surface of the inner block 38 (see FIG. 5).

Referring still to FIG. 2, in the illustrated embodiment, the roller dial plate 42 includes an annular base portion and an annular web portion that extends radially outward from the base portion. The base portion of the roller dial plate 42 includes an aperture through which the annular flange 52 of the inner block 38 is disposed. The roller dial plate 42 is disposed relative to the annular flange 52 of the inner block 38 such that the roller dial plate 42 is operable to freely rotate about the annular flange 52 when the inner block 38 and the roller dial plate 42 are concentrically aligned. The roller dial plate 42 includes a plurality of arms that extend radially outward from the web portion of the of the roller dial plate 42. Each of the arms includes a radially extending channel that is operable to receive the cylindrical roller flange of a roller 40.

Figure 6:
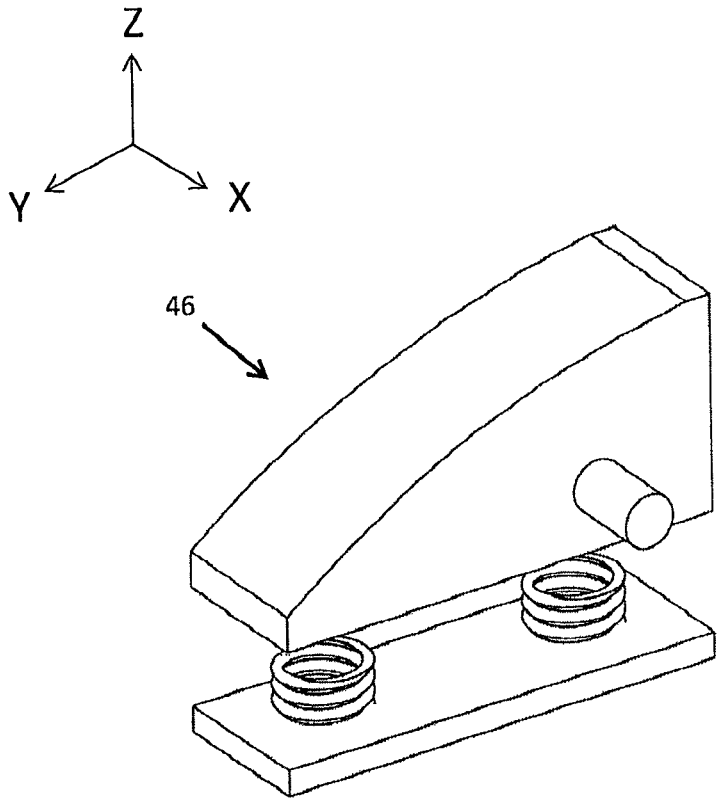
FIG. 6 illustrates a perspective view of a component of the brake of FIG. 1.

Referring to FIG. 6, in the illustrated embodiment, the wedge 46 includes a wedge body that is connected to a wedge base by a plurality of springs, and a cylindrical wedge flange that extends from the wedge body along a lengthwise-extending axis. Referring to FIG. 2, in the illustrated embodiment, each wedge 46 is positioned within one of the above-described channels such that the wedge base contacts a recess portion 62 of the outer surface of the inner block 38 (see FIG. 5).

Referring still to FIG. 2, in the illustrated embodiment, each wedge 46 is operable to be moved between an inactive position and an active position. In the illustrated embodiment, when the wedge 46 is in the inactive position, the wedge 46 is disposed proximate the first end 64 of the recess portion 62 of the outer surface of the inner block 38 (see FIG. 5). When the wedge 46 is in the active position, the wedge 46 is disposed proximate the second end 66 of the recess portion 62 of the outer surface of the inner block 38 (see FIG. 5).

In the illustrated embodiment, the wedge dial plate 48 includes an annular base portion and an annular web portion that extends radially outward from the base portion. The base portion of the wedge dial plate 48 includes an aperture through which the annular flange 52 of the inner block 38 is disposed. The wedge dial plate 48 is disposed relative to the annular flange 52 of the inner block 38 such that the wedge dial plate 48 is operable to freely rotate about the annular flange 52 when the inner block 38 and the wedge dial plate 48 are concentrically aligned. The wedge dial plate 48 includes a plurality of arms that extend radially outward from the web portion of the wedge dial plate 48. Each of the arms includes a radially extending channel that is operable to receive the cylindrical wedge flange of a wedge 46.

In the illustrated embodiment, the first actuator 44 is operable to move at least one of the rollers 40 between the inactive position and the active position, and the second actuator 50 is independently operable to move at least one of the wedges 46 between the inactive position and the active position, as will be described further below. In the illustrated embodiment, the roller dial plate 42 engages the cylindrical roller flanges such that movement of one of the rollers 40 from the inactive position to the active position causes movement of the other rollers 40 from the inactive position to the active position, and vice versa. In the illustrated embodiment, the wedge dial plate 48 engages the cylindrical wedge flanges such that movement of one of the wedges 46 from the inactive position to the active position causes movement of the other wedges 46 from the inactive position to the active position, and vice versa.

Referring still to FIG. 2, in the illustrated embodiment, the escalator system 12 additionally includes a controller (not shown) that is operable to control the brake 10. The controller is operable to independently control the first and second actuators 44, 46 to perform the functionality described herein. The functionality of the controller may be implemented using hardware, software, firmware, or a combination thereof. In some embodiments, for example, the controller includes one or more programmable processors. A person having ordinary skill in the art would be able to adapt (e.g., program) the controller to perform the functionality described herein without undue experimentation.

Referring to FIG. 1, during operation of the escalator system 12 illustrated in the drawings, the drive motor 20 rotationally drives the input portion of the gearbox 22, which drives the output portion of the gearbox 22, which drives the transmission device 24, which drives the drive shaft 26, which drives the first and second sprockets 28, 30, which drive the escalator step band 31. In the illustrated embodiment, movement of the first and second sprockets 28, 30 causes corresponding movement of the outer ring 36 (see FIG. 2) of the brake 10.

Figure 7:
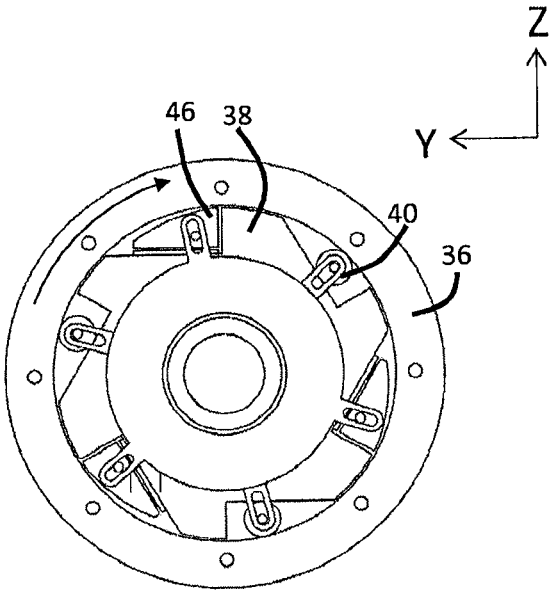
FIG. 7 illustrates a front elevation view of components of the brake of FIG. 1.
Figure 8:
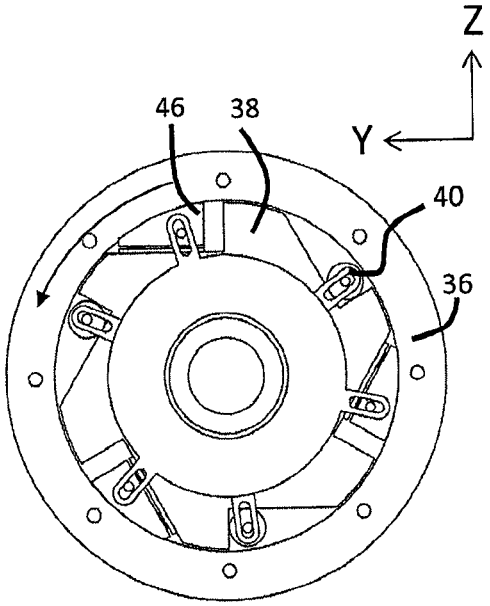
FIG. 8 illustrates a front elevation view of components of the brake of FIG. 1.

Referring to FIG. 1, in the illustrated embodiment, the escalator system 12 can convey passengers from a lower level of a building to a higher level of a building (e.g., during "upward running travel"), or the escalator 12 can convey passengers from a higher level of a building to a lower level of a building (e.g., during "downward running travel"). FIGS. 7-8 include arrows to indicate the direction of rotation of the outer ring 36 of the brake 10, which corresponds to the direction of rotation of the escalator step band 31 (see FIG. 1). FIG. 7 illustrates clockwise rotation of the outer ring 36, which corresponds to movement of the escalator step band 31 in a desired direction during upward running travel. FIG. 8 illustrates counterclockwise rotation of the outer ring 36, which corresponds to movement of the escalator step band 31 in a desired direction during downward running travel.

FIG. 7 illustrates the rollers 40 in the active position, and the wedges 46 in the inactive position. FIG. 8 illustrates the rollers in the inactive position, and the wedges 46 in the active position.

During upward running travel of the escalator system 12 illustrated in the drawings, the brake 10 can be configured as shown in FIG. 7. In this configuration, when the outer ring 36 is rotated in the clockwise direction as shown in FIG. 7, the rollers 40 interact with the inner block 38 and the outer ring 36 without braking or holding the second sprocket 30. When the direction of rotation of the outer ring 36 is reversed (e.g., during a malfunction condition of the escalator system 12), the brake 10 is self-actuated, and the rollers 40 interact with the inner block and the outer ring 36 to instantaneously brake and hold the outer ring 36, which in turn instantaneously brakes and holds the second sprocket 30 and the escalator step band 31 (see FIG. 1). The brake 10 is thus operable to instantaneously prevent a reversal in the direction of rotation of the escalator step band 31, and thus can be described as providing instantaneous reversal protection. This feature of the brake 10 provides significant advantages over other brakes that can provide only progressive reversal protection. For example, because the brake 10 can provide instantaneous reversal protection, the brake 10 can prevent situations in which passengers are at a risk of falling while movement of the escalator step band 31 in the reverse direction is progressively slowed and stopped. In other embodiments not shown in the drawings, the brake 10 can be used as a safety mechanism to prevent reversal in the movement direction of an elevator car in the event of a system failure. In this configuration, the brake 10 is operable to provide instantaneous reversal protection by mechanical means, and thus provides significant advantages over other brakes that provide reversal protection only in response to an electrical control signal.

During downward running travel of the escalator system 12 illustrated in the drawings, the brake 10 can be configured as shown in FIG. 8. During an overspeed condition, in which the speed of the escalator step band 31 is above a predetermined threshold speed, the wedges 46 can be moved from the inactive position to the active position, as shown in FIG. 8. The second actuator 50 can move the wedges 46 to the active position in response to a signal from the controller (not shown) that indicates the overspeed condition of the escalator system 12. In the active position, the wedges 46 can interact with the inner block and the outer ring 36 to progressively brake the outer ring 36, which in turn progressively brakes the second sprocket 30 and the escalator step band 31 (see FIG. 1). The brake 10 is thus operable to decrease the speed of the escalator step band 31 to return the escalator system to a normal operation condition, and can therefore be described as providing overspeed protection. In some instances, the interaction with the inner block and the outer ring 36 can, by itself, move the wedges 46 further toward the respective second ends 66 of the recess portions 62 of the inner block 38, until the wedges 46 interact with the inner block and the outer ring 36 to hold the outer ring 36.

While several embodiments have been disclosed, it will be apparent to those of ordinary skill in the art that aspects of the present invention include many more embodiments and implementations. Accordingly, aspects of the present invention are not to be restricted except in light of the attached claims and their equivalents. It will also be apparent to those of ordinary skill in the art that variations and modifications can be made without departing from the true scope of the present disclosure. For example, in some instances, one or more features disclosed in connection with one embodiment can be used alone or in combination with one or more features of one or more other embodiments.

What is claimed is:

1. A brake for use in a passenger conveyor system, the passenger conveyor system including a drive system operable to drive a drive component in a desired direction, wherein the brake is actuated by a reversal in direction of movement of the drive component, wherein the drive system is operable to rotationally drive the drive component in the desired direction; and wherein the brake further comprises:

an outer ring connected to the drive component such that the outer ring and the drive component are concentrically aligned about a rotation axis; and an inner block disposed within a cavity defined by the outer ring such that the inner block and the outer ring are axially and concentrically aligned, the inner block being configured such that a first channel is formed between the inner block and the outer ring.

2. The brake of claim 1, wherein the passenger conveyor system is an elevator system.

3. The brake of claim 1, wherein the passenger conveyor system is an escalator system.

4. The brake of claim 1, wherein the brake instantaneously brakes the drive component when actuated by the reversal in direction of movement of the drive component.

5. The brake of claim 4, wherein the brake slows movement of the drive component at a deceleration rate greater than 1 meter/second$^2$.

6. The brake of claim 1, wherein the brake progressively brakes the drive component when actuated by the reversal in direction of movement of the drive component.

7. The brake of claim 1, wherein the brake is operable to brake the drive component to prevent an overspeed condition in which the drive component moves in the desired direction at a speed greater than a predetermined threshold speed.

8. The brake of claim 1, further comprising a first roller positioned within the first channel, the first roller being moveable within the first channel between an active position and an inactive position.

9. The brake of claim 8, wherein when the first roller is in the active position, the first roller is operable to interact with the inner block and the outer ring to instantaneously brake the outer ring, which in turn instantaneously brakes the drive component of the drive system; and wherein when the first roller is in the inactive position, the first roller is not operable to interact with the inner block and the outer ring to instantaneously brake the outer ring.

10. The brake of claim 9, further including an actuator operable to move the first roller between the active position and the inactive position.

11. The brake of claim 1, further comprising a first wedge positioned within the first channel, the first wedge being moveable within the first channel between an active position and an inactive position.

12. The brake of claim 11, wherein when the first wedge is in the active position, the first wedge is operable to interact with the inner block and the outer ring to brake the outer ring, which in turn brakes the drive component of the drive system; and wherein when the first wedge is in the inactive position, the first wedge is not operable to interact with the inner block and the outer ring to brake the outer ring.

13. The brake of claim 12, wherein interaction between the first wedge, the inner block, and the outer ring is operable, by itself, to move the first wedge within the first channel, until the first wedge, the inner block, and the outer ring interact to hold the outer ring.

14. The brake of claim 11, further including an actuator operable to move the first wedge between the active position and the inactive position.

15. The brake of claim 1, wherein the brake is self-actuated by the reversal in direction of movement of the drive component.

16. A passenger conveyor system, comprising:

a drive system operable to drive a drive component in a first direction;

a brake operable to brake the drive component to prevent an overspeed condition in which the drive component moves in the first direction at a speed greater than a predetermined threshold speed, and operable to brake the drive component to prevent movement of the drive component in a second direction that is a reverse of the first direction, wherein the brake is actuated by a change in direction of movement of the drive component from the first direction to the second direction;

wherein the drive system is operable to rotationally drive the drive component in the first direction; and wherein the brake further comprises:

an outer ring connected to the drive component such that the outer ring and the drive component are concentrically aligned about a rotation axis; and an inner block disposed within a cavity defined by the outer ring such that the inner block and the outer ring are axially and concentrically aligned, the inner block being configured such that a first channel is formed between the inner block and the outer ring.

17. The passenger conveyor system of claim 16, wherein the brake instantaneously brakes the drive component when actuated by the change in direction.

18. The passenger conveyor system of claim 16, wherein the brake slows movement of the drive component at a deceleration rate greater than 1 meter/second$^2$.

19. The passenger conveyor system of claim 16, wherein the brake progressively brakes the drive component when actuated by the change in direction.

20. The passenger conveyor system of claim 16, wherein the passenger conveyor system is an elevator system.

21. The passenger conveyor system of claim 16, wherein the passenger conveyor system is an escalator system.

22. The passenger conveyor system of claim 16, further comprising a first roller positioned within the first channel, the first roller being moveable within the first channel between an active position and an inactive position.

23. The passenger conveyor system of claim 22, wherein when the first roller is in the active position, the first roller is operable to interact with the inner block and the outer ring to instantaneously brake the outer ring, which in turn instantaneously brakes the drive component of the drive system; and wherein when the first roller is in the inactive position, the first roller is not operable to interact with the inner block and the outer ring to instantaneously brake the outer ring.

24. The passenger conveyor system of claim 23, further including an actuator operable to move the first roller between the active position and the inactive position.

25. The passenger conveyor system of claim 16, further comprising a first wedge positioned within the first channel, the first wedge being moveable within the first channel between an active position and an inactive position.

26. The passenger conveyor system of claim 25, wherein when the first wedge is in the active position, the first wedge is operable to interact with the inner block and the outer ring to brake the outer ring, which in turn brakes the drive component of the drive system; and wherein when the first wedge is in the inactive position, the first wedge is not operable to interact with the inner block and the outer ring to brake the outer ring.

27. The passenger conveyor system of claim 25, wherein interaction between the first wedge, the inner block, and the outer ring is operable, by itself, to move the first wedge within the first channel, until the first wedge, the inner block, and the outer ring interact to hold the outer ring.

28. The passenger conveyor system of claim 25, further including an actuator operable to move the first wedge between the active position and the inactive position.

29. The passenger conveyor system of claim 16, wherein the brake is provided as a single unit.

30. The passenger conveyor system of claim 16, wherein the brake is self-actuated by the change in direction of movement of the drive component from the first direction to the second direction.

* * * * *